US005839785A

United States Patent [19]

Miller et al.

[11] Patent Number: 5,839,785

[45] Date of Patent: Nov. 24, 1998

[54] THEATER SEAT HOLD-DOWN DEVICE

[76] Inventors: Vickie B. Miller; Terry A. Miller, both of 1218 Oak Park Ave., Maryville, Tenn. 37803

[21] Appl. No.: 399,571

[22] Filed: Mar. 7, 1995

[51] Int. Cl.[6] ..... A47C 7/54

[52] U.S. Cl. ..... 297/411.2; 248/455; 297/331

[58] Field of Search ..... 297/331, 332, 297/333, 411.2; 108/150; 40/331; 292/339, 288; 248/455, 456

[56] References Cited

U.S. PATENT DOCUMENTS

| | | | |
|---|---|---|---|
| 756,740 | 4/1904 | Trum | 248/455 |
| 1,276,735 | 8/1918 | Devney | 40/331 X |
| 2,305,426 | 12/1942 | Howell | 40/331 X |
| 2,618,497 | 11/1952 | Gardels | 292/288 X |
| 3,705,557 | 12/1972 | Budington | 108/150 X |
| 4,216,598 | 8/1980 | Newbert | 40/331 X |
| 4,300,796 | 11/1981 | Lane | 292/339 |
| 4,460,119 | 7/1984 | Goodfellow et al. | 229/68 X |
| 4,563,027 | 1/1986 | Chechovsky et al. | 292/339 |
| 5,290,003 | 3/1994 | Reyes | 248/455 X |
| 5,303,980 | 4/1994 | Young | 297/251 |
| 5,332,286 | 7/1994 | Atherton et al. | 297/256 |

*Primary Examiner*—Peter R. Brown
*Assistant Examiner*—Stephen Vu
*Attorney, Agent, or Firm*—Pitts & Brittian, P.C.

[57] ABSTRACT

A theater seat hold-down device for holding down a spring loaded or biased theater seat. The theater seat hold-down device is constructed to engage the armrest assembly and at least one seat member in a manner such that the theater seat is maintained in a substantially horizontal orientation.

8 Claims, 4 Drawing Sheets

THEATER SEAT HOLD-DOWN DEVICE

TECHNICAL FIELD

This invention relates to the field of theater seats and more particularly to a device for holding down the spring loaded seat member of a theater seat or the like.

BACKGROUND ART

Conventionally, theater seats or arena seats include a spring loaded or biased seat member which pivots to rest against the seat back when not in use. The spring loaded seat member requires a threshold amount of weight to hold down the seat member. In many cases, a small child does not weigh enough to keep the seat member in a horizontal orientation.

The devices disclosed in U.S. Pat. No. 5,303,980 issued Apr. 19, 1994 to T. W. Young and U.S. Pat. No. 5,332,286 issued Jul. 26, 1994 to Atherton et al. provide a means for boosting a child up in a seat. The '980 patent teaches a booster seat which rests on the arms of the theater seats and supports the child above the seat member. The booster seat is not intended to maintain the seat member in a horizontal orientation. Further, the booster seat does not provide the comfort and support provided when sitting in the theater seat.

The device disclosed in the '286 patent is an invertible booster seat apparatus which is configured to be received within a conventional theater seat. The booster seat is similar to a conventional booster seat but fits more securely within the theater seat. The booster seat does not necessarily hold down the seat member when a child is seated in the booster seat. Further, the booster seat is bulky such that it is inconvenient to carry the device to and from a theater, arena or stadium.

Therefore, it is an object of the present invention to provide a theater seat hold-down device which holds down a spring-loaded theater seat.

It is another object of the present invention to provide a theater seat hold-down device which is conveniently sized such that a plurality of the theater seat hold-down devices can be carried at one time.

DISCLOSURE OF THE INVENTION

Other objects and advantages will be accomplished by the present invention which serves to hold down a spring loaded or biased seat member of a conventional theater seat. The theater seat hold-down device of the present invention is configured to engage the armrest assembly and at least one seat member adjacent to the armrest assembly in a manner such that the seat member is maintained in a substantially horizontal orientation.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A theater seat hold-down device incorporating various features of the present invention is illustrated generally at 10 in the figures. The theater seat hold-down device 10 is designed for holding down the spring-loaded seat member of a theater seat in a manner such that no weight is required to maintain the seat member in a horizontal orientation. Moreover, in the preferred embodiment the theater seat hold-down device 10 is designed to be conveniently sized such that a plurality of the devices 10 can be carried at one time.

Figure 1:
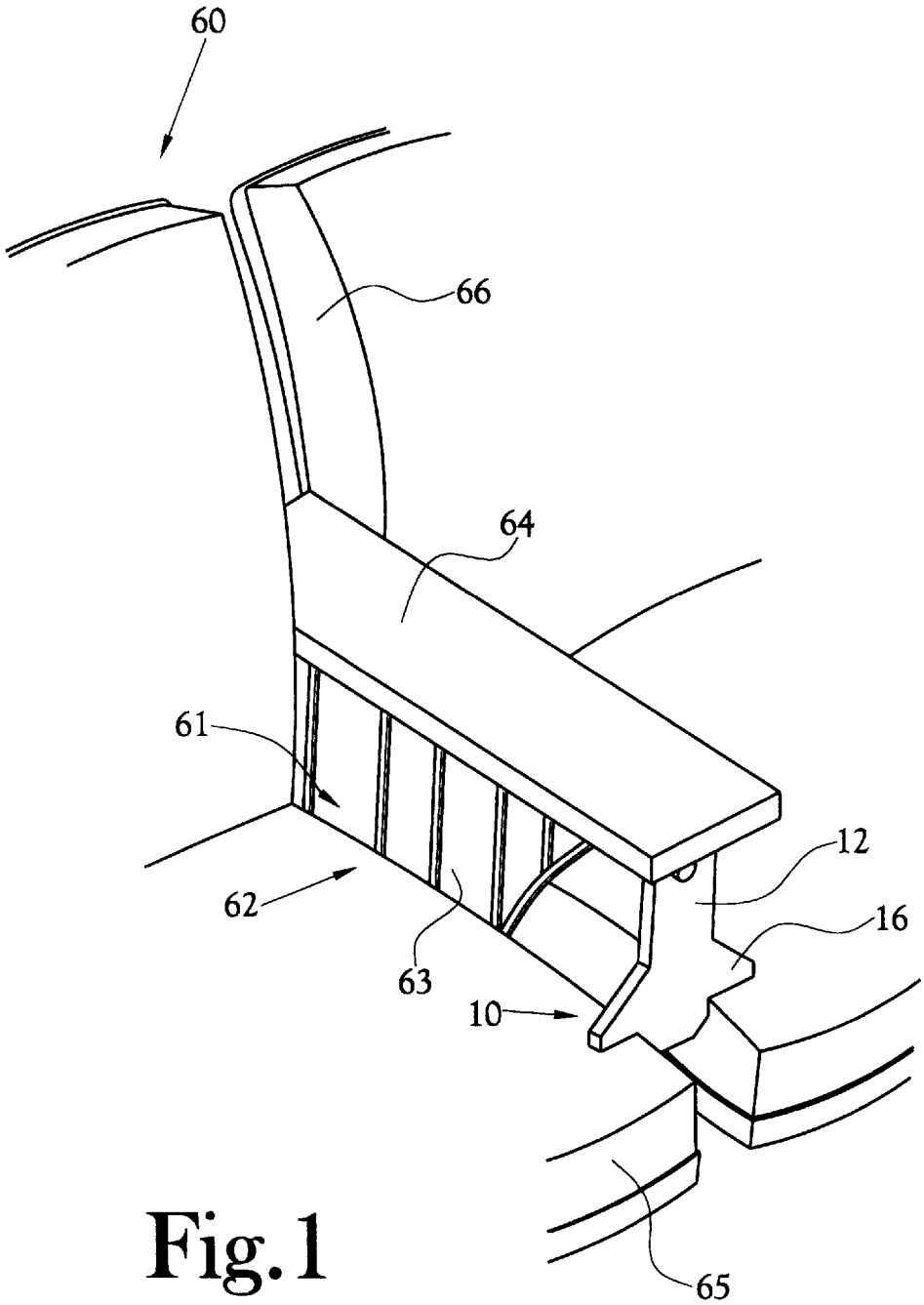
FIG. 1 is a perspective view of the theater seat hold-down device constructed in accordance with several features of the present invention illustrated holding two theater seat members in a substantially horizontal orientation.

Conventional theater seats 60 includes a support leg 61 disposed on each side thereof, and each support leg 61 carries an armrest assembly 62 including an armrest 64 and an armrest support 63. The theater seat 60 further includes a spring-loaded seat member 65 and a seat back 66, as shown in FIG. 1. The theater seat hold-down device 10 is configured to hold down the spring-loaded seat member 65 of a conventional theater or arena seat 60 in a manner such that the seat member 65 does not pivot to a vertical orientation when the user rises from the seat member 65 or when the weight of the person on the seat member 65 is not sufficient to hold the seat member in a substantially horizontal orientation. One manner for positioning the theater seat hold-down device 10 to hold down adjacent conventional theater seat members 65 is shown in FIG. 1. Generally, the theater seat hold-down device 10 is constructed to engage the armrest assembly 62 and at least one of the seat members 65 adjacent to the armrest assembly 62 in a manner such that seat member 65 is held in a substantially horizontal orientation. In the preferred embodiment, the theater seat hold-down device 10 is constructed to be adaptable to a variety of conventional theater seats 60. It will be noted that conventional theater seats 60 include the same basic components, but the dimensions of one model of theater chairs will vary from other models.

Figure 2:
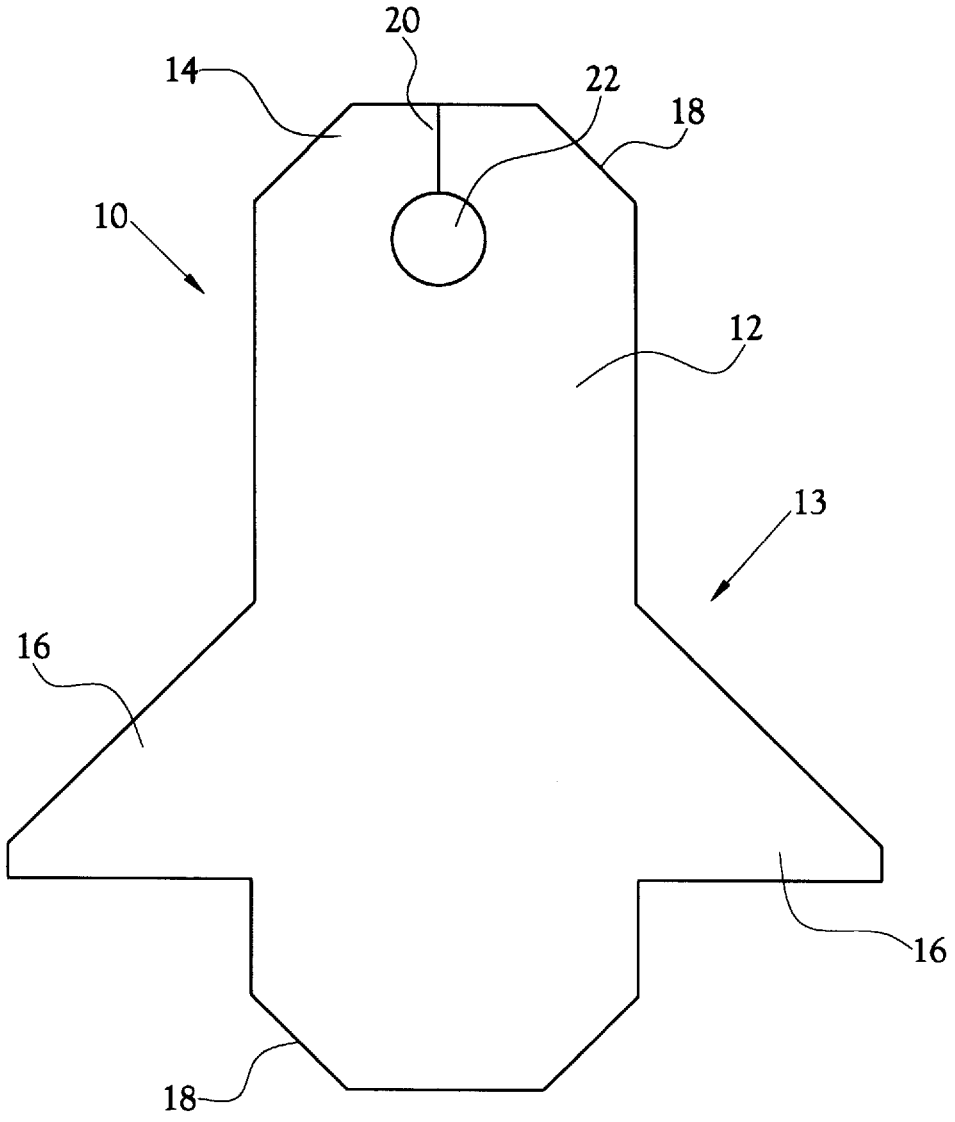
FIG. 2 illustrates a detailed view of the theater seat hold-down device.

Generally, the theater seat hold-down device 10 is comprised of an elongated section 12 with wings 16 secured to either side at a lower end 13 thereof, as shown in FIG. 2. In the preferred embodiment, the theater seat hold-down device 10 further defines beveled corners 18 and a slit 20 and circular opening 22 at an upper end 14 of the elongated section 12. The slit 20 is constructed to be separable providing access to the opening 22. Preferably, the theater seat hold-down device 10 is unitary and constructed from a resilient material such as rubber. In the preferred embodiment, the elongated section 12 is approximately 8 inches in length, 3 inches in width and approximately 0.5 inches in depth. The wing span is approximately 7 inches. It will be noted that the dimensions can be altered, and therefore, it is not intended to limit the present invention to those dimensions disclosed.

In FIG. 1, the theater seat hold-down device 10 is positioned such that it is wedged between the armrest 64 and the two seat members 65 adjacent to the armrest 64. The bottom surface of each of the wings 16 rests against a respective seat member 65 and the upper end of the elongated portion 12 rests against the underside of the armrest 64. The theater seat hold-down device 10 is sufficiently rigid to maintain the seat members 65 in a substantially horizontal orientation.

Figure 3:
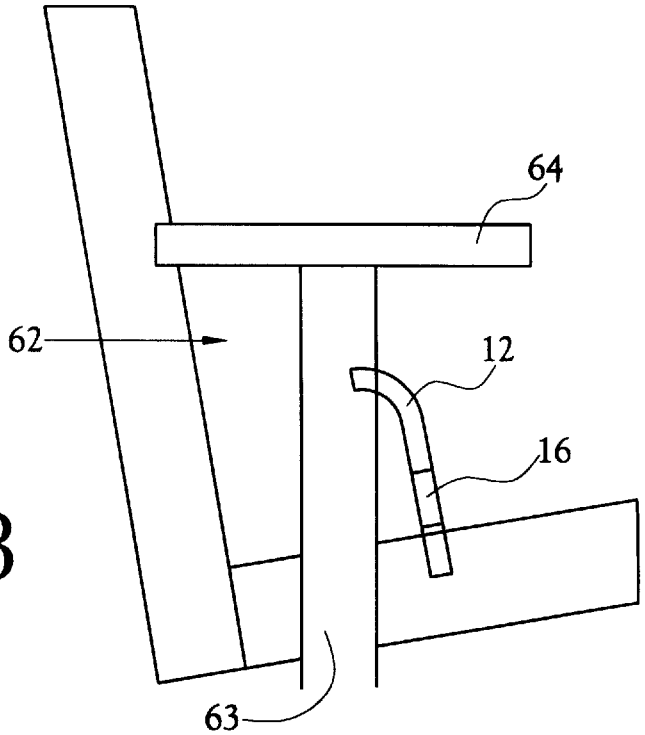
FIG. 3 illustrates an alternate means for positioning the theater seat hold-down device.

FIG. 3 illustrates the hold-down device 10 in a flexed position wherein the slit 20 is separated and the opening 22 receives a portion of the leading edge of the armrest support 63. The armrest support 63 of conventional theater seats 60 define a circular configuration along the perimeter. The slit 20 and opening 22 are configured to receive the perimeter of the armrest support 63. As shown in FIG. 3, the circular opening 22 and slit 20 establish frictional contact with the armrest support 63 and the bottom face of each wing 16 is wedged against the seat members 65 adjacent to the armrest support 63. To this extent, the theater seat hold-down device 10 is fabricated from a flexible, yet resilient, material.

Figure 4:
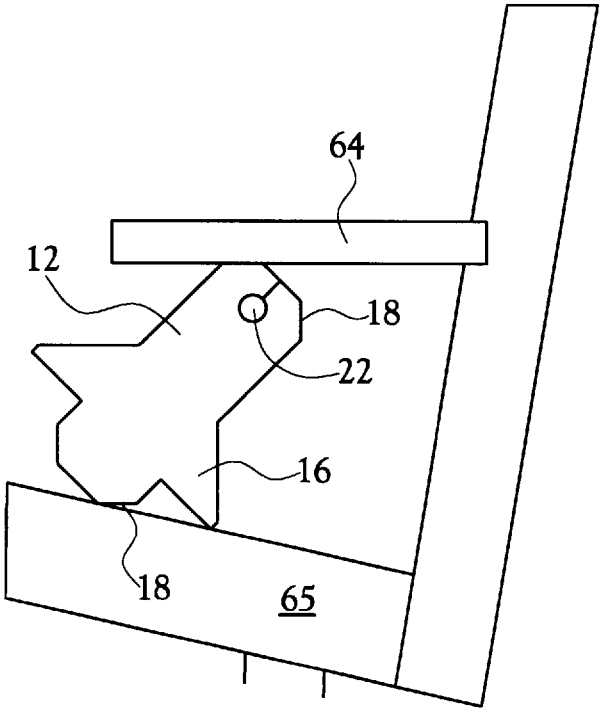
FIG. 4 illustrates an alternate means for positioning the theater seat hold-down device.

FIG. 4 illustrates the theater seat hold-down device 10 wedged between the underside of an armrest 64 and a seat member 65 in an inclined fashion such that a beveled corner 18 contacts the underside of the armrest 64 and the diagonally opposing beveled corner 18 and wing 16 are supported against the seat member 65. Of course, it will be noted that other orientations of the theater seat hold-down device 10 may be incorporated as well to accomplish this same function.

Figure 5:
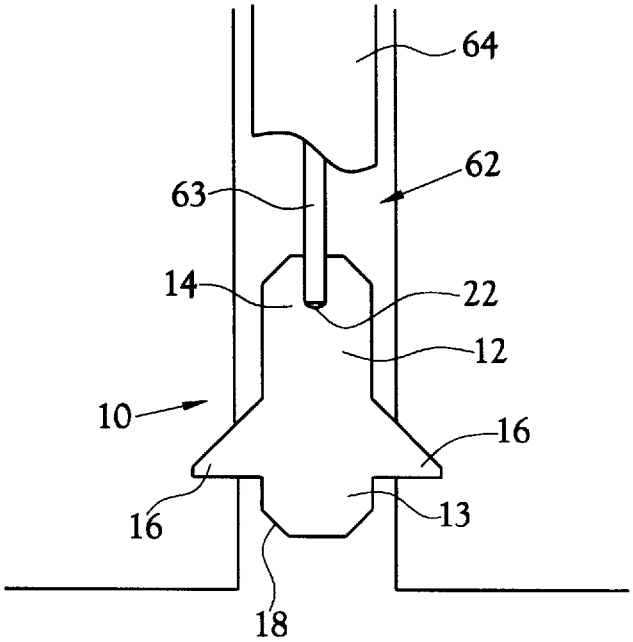
FIG. 5 illustrates an alternate means for positioning the theater seat hold-down device; and, FIG. 6 is a side view of the theater seat hold-down device as positioned in FIG. 5.
Figure 6:
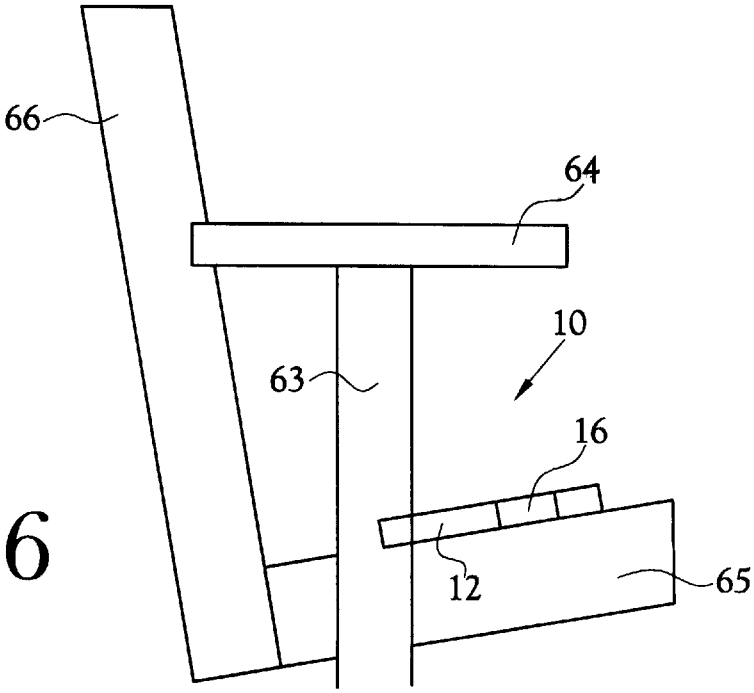

FIGS. 5 and 6 illustrate the theater seat hold-down device 10 in a substantially horizontal orientation wherein the slit 20 and opening 22 frictionally receive the armrest support 63 proximate the adjacent seat members 65. The face of each wing 16 rests against the adjacent seat member 65. The frictional contact between the slit 20 and opening 22 and the armrest support 63 is sufficient to maintain the seat member 65 in a substantially horizontal orientation.

From the foregoing description, it will be recognized by those skilled in the art that a theater seat hold-down device offering advantages over the prior art has been provided. Specifically, the theater seat hold-down device provides a means for holding a theater seat in a substantially horizontal orientation. Further, the theater seat hold-down device is configured to be adaptable to a variety of conventional theater or arena seats. Moreover, the theater seat hold-down device is easily manipulated into position and a plurality of the theater seat hold-down devices are easily carried.

While a preferred embodiment has been shown and described, it will be understood that it is not intended to limit the disclosure, but rather it is intended to cover all modifications and alternate methods falling within the spirit and the scope of the invention as defined in the appended claims.

We claim:

1. A theater seat hold-down device for maintaining a seat member of at least one conventional theater seat in a substantially horizontal orientation, said conventional theater seat including an a disposed on either side of a seat member, said armrest assembly including an armrest support, the conventional theater seat further including a biasing device for biasing the seat member in a substantially vertical orientation when the seat member is not use, said theater seat hold-down device comprising:

an elongated member adapted to extend between an armrest assembly and a seat member, said elongated member defining an armrest assembly engagement portion and a seat engagement portion, said armrest assembly engagement portion being configured to engage the armrest assembly and said seat engagement portion being configured to engage at least one seat member adjacent to the armrest assembly such that the seat member is maintained in a substantially horizontal orientation, said elongated member defining at least two beveled corners diagonally opposed one from another.

2. The theater seat hold-down of claim 1 wherein said seat engagement portion defines at least one wing extending from said elongated member, said at least one wing being provided for engaging a top surface of the seat member.

3. The theater seat hold-down of claim 2 wherein said seat engagement portion defines two wings extending from opposing sides of said elongated member.

4. A theater seat hold-down device for maintaining a seat member of at least one conventional theater seat in a substantially horizontal orientation, said conventional theater seat including an armrest assembly disposed on either side of a seat member, the armrest assembly including an armrest and an armrest support, the conventional theater seat further including a biasing device for biasing the seat member in a substantially vertical orientation when the seat member is not in use, said theater seat hold-down device comprising:

an elongated member adapted to extend between an armrest assembly and a seat member, said elongated member defining an armrest assembly engagement portion and a seat engagement portion, said armrest assembly engagement portion being configured to engage the armrest assembly and said seat engagement portion being configured to engage at least one seat member adjacent to the armrest assembly such that the seat member is maintained in a substantially horizontal orientation, said seat engagement portion defining two wings extending from opposing sides of said elongated member, said at least one wing being provided for engaging a top surface of the seat member, said armrest assembly engagement portion further defining a through opening and a slit, said slit being defined between an upper end of said elongated member at a central portion thereof and said through opening, said slit providing access to said through opening for closely receiving the armrest support, said elongated member being fabricated from a flexible, yet resilient, material that is sufficiently rigid to maintain the seat members in a substantially horizontal orientation, overcoming biasing forces exerted by the biasing device, said elongated member defining at least two beveled corners diagonally opposed one from another.

5. A theater seat hold-down device for maintaining a seat member of at least one conventional theater seat in a substantially horizontal orientation, said conventional theater seat including an armrest assembly disposed on either side of a seat member, said armrest assembly including an armrest and an armrest support, the conventional theater seat further including a biasing device for biasing the seat member in a substantially vertical orientation when the seat member is not in use, said theater seat hold-down device comprising:

an elongated member adapted to extend between an armrest assembly and a seat member, said elongated member defining an armrest assembly engagement portion and a seat engagement portion, said armrest assembly engagement portion being configured to engage the armrest assembly and said seat engagement portion being configured to engage at least one seat member adjacent to the armrest assembly such that the seat member is maintained in a substantially horizontal orientation, said elongated member being fabricated from a flexible, yet resilient, material that is sufficiently rigid to maintain the seat members in a substantially horizontal orientation, overcoming biasing forces exerted by the biasing device, said armrest assembly engagement portion defining a through opening and a slit, said slit being defined between an upper end of said elongated member at a central portion thereof and said through opening, said slit providing access to said through opening for closely receiving the armrest support, said seat engagement portion defining at least one wing extending from said elongated member, said at least one wing being provided for engaging a top surface of the at least one seat member.

6. The theater seat hold-down of claim 5 wherein said seat engagement portion defines two wings extending from opposing sides of said elongated member.

7. The theater seat hold-down claim 5 wherein said elongated member defines at least two beveled corners diagonally opposed one from another.

8. A theater seat hold-down device for maintaining a seat member of at least one conventional theater seat in a substantially horizontal orientation, said conventional theater seat including an armrest assembly disposed on either side of a seat member, the armrest assembly including an armrest and an armrest support, the conventional theater seat further including a biasing device for biasing the seat member in a substantially vertical orientation when the seat member is not in use, said theater seat hold-down device comprising:

an elongated member adapted to extend between an armrest assembly and a seat member, said elongated member defining an armrest assembly engagement portion and a seat engagement portion, said armrest assembly engagement portion being configured to engage the armrest assembly and said seat engagement portion being configured to engage at least one seat member adjacent to the armrest assembly such that the seat member is maintained in a substantially horizontal orientation, wherein said armrest assembly engagement portion defines a through opening and a slit, said slit being defined between an upper end of said elongated member at a central portion thereof and said opening, said slit providing access to said through opening for closely receiving the armrest support, said elongated member being fabricated from a flexible, yet resilient, material that is sufficiently rigid to maintain the seat members in a substantially horizontal orientation, overcoming biasing forces exerted by the biasing device.

* * * * *